US009409398B2

(12) United States Patent
Nakagawa et al.

(10) Patent No.: US 9,409,398 B2
(45) Date of Patent: Aug. 9, 2016

(54) MAINTENANCE UNIT AND LIQUID EJECTING APPARATUS

(71) Applicant: SEIKO EPSON CORPORATION, Tokyo (JP)

(72) Inventors: Shigenori Nakagawa, Tatsuno-machi (JP); Keiji Matsumoto, Matsumoto (JP); Toshinobu Yamazaki, Niigata (JP); Masahiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/939,774

(22) Filed: Nov. 12, 2015

(65) Prior Publication Data

US 2016/0144626 A1 May 26, 2016

(30) Foreign Application Priority Data

Nov. 21, 2014 (JP) ..... 2014-236783

(51) Int. Cl.
*B41J 2/165* (2006.01)

(52) U.S. Cl.
CPC ..... *B41J 2/165* (2013.01); *B41J 2002/1655* (2013.01)

(58) Field of Classification Search
CPC ..... B41J 2002/1655; B41J 2002/16591; B41J 2002/16573; B41J 2/165
See application file for complete search history.

(56) References Cited

U.S. PATENT DOCUMENTS

| | | | | |
|---|---|---|---|---|
| 6,820,039 | B2 * | 11/2004 | Johnson | G06Q 30/02 399/27 |
| 2005/0134666 | A1 | 6/2005 | Rousseau | |
| 2008/0252685 | A1 * | 10/2008 | Gomez | B41J 2/16526 347/33 |
| 2011/0205288 | A1 | 8/2011 | Matsuyama et al. | |
| 2012/0121831 | A1 | 5/2012 | Kudoh et al. | |
| 2013/0106968 | A1 | 5/2013 | Matsumoto et al. | |
| 2014/0218440 | A1 | 8/2014 | Komatsu et al. | |

FOREIGN PATENT DOCUMENTS

| | | | |
|---|---|---|---|
| JP | 2002-029065 | A | 1/2002 |
| JP | 2005-138479 | A | 6/2005 |
| JP | 2005-178387 | A | 7/2005 |
| JP | 2013-094982 | A | 5/2013 |
| JP | 2014-148128 | A | 8/2014 |
| WO | W02010050618 | A1 | 5/2010 |
| WO | W02011007888 | A1 | 1/2011 |

* cited by examiner

*Primary Examiner* — Geoffrey Mruk
(74) *Attorney, Agent, or Firm* — Workman Nydegger

(57) ABSTRACT

Provided is a maintenance unit that is detachably attached to a liquid ejecting apparatus including a liquid ejecting section for ejecting liquid, the maintenance unit including: a maintenance section that is used for maintenance of the liquid ejecting section; and a recording target section in which information related to the maintenance section is recorded by the liquid that is ejected by the liquid ejecting section in a visibly recognizable manner.

11 Claims, 7 Drawing Sheets

MAINTENANCE UNIT AND LIQUID EJECTING APPARATUS

BACKGROUND

1. Technical Field

The present invention relates to a maintenance unit that is used for maintenance of a liquid ejecting section and a liquid ejecting apparatus, such as a printer, to which the maintenance unit is detachably attached.

2. Related Art

As an example of a liquid ejecting apparatus, there is an ink jet printer, which is provided with a recording head for ejecting ink for printing, to which a waste liquid cartridge for collecting liquid that is discharged as waste liquid from the recording head for maintenance is exchangeably attached.

The waste liquid cartridge is provided with a storage element that is capable of writing and reading information related to the waste liquid, and a user can exchange the waste liquid cartridge at an appropriate timing by obtaining information related to the waste liquid that is read from the storage element (JP-A-2002-29065, for example).

Incidentally, if the waste liquid cartridge as described above is detached from the printer in the course of usage, it is not possible to obtain information that is written in the storage element without turning on a power source of the printer again and attaching the waste liquid cartridge. Therefore, there is a problem in that it is necessary to turn on the power source of the printer and attach the waste liquid cartridge, which requires time and efforts, in order to check whether or not the waste liquid cartridge in a state of being detached from the printer can be used in another printer.

Such a problem is substantially common to maintenance units that are provided with maintenance sections, the amounts of usage and validity dates of which are limited, and that are attached to and detached from the liquid ejecting apparatuses as well as the waste liquid cartridge that is exchangeably attached to a printer that performs printing by ejecting ink.

SUMMARY

An advantage of some aspects of the invention is to provide a maintenance unit that is capable of obtaining necessary information without being attached to a liquid ejecting apparatus and a liquid ejecting apparatus to which the maintenance unit is attached.

Hereinafter, means of the invention and operation effects thereof will be described.

According to an aspect of the invention, there is provided a maintenance unit that is detachably attached to a liquid ejecting apparatus including a liquid ejecting section for ejecting liquid, the maintenance unit including: a maintenance section that is used for maintenance of the liquid ejecting section; and a recording target section in which information related to the maintenance section is recorded by the liquid that is ejected by the liquid ejecting section in a visibly recognizable manner.

With such a configuration, information related to the maintenance section is brought into a state in which the information can be visually recognized from the outside by the liquid ejecting section performing recording on a recording target section when the maintenance unit is attached to the liquid ejecting apparatus. That is, it is possible to obtain the information related to the maintenance section even in a state in which the maintenance unit is detached from the liquid ejecting apparatus and to thereby obtain necessary information without attaching the maintenance unit to the liquid ejecting apparatus.

In relation to the maintenance unit, the information includes information related to a date on which the maintenance unit is attached to the liquid ejecting apparatus.

With such a configuration, it is possible to easily recognize remaining dates until the validity date based on the recorded information in a case in which the validity date is set for the maintenance section, by recording the information related to the data, on which the maintenance unit is attached to the liquid ejecting apparatus, on the recording target section.

In relation to the maintenance unit, the information includes information related to a date on which the maintenance unit is detached from the liquid ejecting apparatus.

With such a configuration, it is possible to expect a degree of degradation based on the recorded information in a case in which there is a concern that the maintenance section after start of usage is degraded over time, by recording the information related to the date, on which the maintenance unit is detached form the liquid ejecting apparatus, on the recording target section.

In relation to the maintenance unit, the information includes information related to a usage history of the maintenance section.

With such a configuration, it is possible to easily know how long the maintenance unit can be used from then based on the recorded information in a case in which the number of times of usage of the maintenance section is limited, by recording the information related to the usage history of the maintenance section on the recording target section.

In relation to the maintenance unit, the information includes information related to the liquid ejecting apparatus to which the maintenance unit is attached.

For example, a type of liquid to be used differs depending on a type of the liquid ejecting apparatus. If the maintenance unit in the course of usage is used with both the different liquid ejecting apparatuses in a case in which it is not preferable that the liquid adheres to the liquid ejecting section of the different liquid ejecting apparatuses, there is a concern that the unnecessary liquid adheres to another liquid ejecting section via the maintenance section. On that regard, according to the aforementioned configuration, it is possible to avoid unnecessary re-attachment to the liquid ejecting apparatus by recording the information related to the liquid ejecting apparatus, to which the maintenance unit is attached, on the recording target section and referring to the recorded information.

In relation to the maintenance unit, the validity date of the maintenance unit is recorded in advance on the recording target section.

With such a configuration, it is possible to easily recognize how long the maintenance unit can be used from then by referring to the validity date that is recorded in advance on the recording target section without attaching the maintenance unit to the liquid ejecting apparatus.

In relation to the maintenance unit, information related to a product name of the maintenance unit is recorded in advance on the recording target section.

With such a configuration, it is possible to appropriately attach the maintenance unit to the liquid ejecting apparatus that is compatible with the product by referring to the product name that is recorded in advance on the recording target section.

In relation to the maintenance unit, information related to the product name is recorded in advance as a machine-readable code on the recording target section.

With such a configuration, the information related to the product name is recorded as a machine-readable code on the recording target section, thereby allowing the user to obtain detailed information of the product by reading the code with a machine even in a case in which a region of the recording target section is not sufficiently large to record the information related to the product name. In doing so, it is possible to correctly order a new maintenance unit for replacement based on the information obtained from the code.

According to another aspect of the invention, there is provided a liquid ejecting apparatus including: a liquid ejecting section that ejects liquid; and an attachment section to which a maintenance unit including a recording target section and a maintenance section that is used for maintenance of the liquid ejecting section is detachably attached, in which information related to the maintenance section is recorded in the liquid ejecting section in a visibly recognizable manner by ejecting the liquid to the recording target section of the maintenance unit that is attached to the attachment section.

With such a configuration, it is possible to obtain the same advantages in that of the aforementioned maintenance unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a description will be given of an embodiment of a maintenance unit and a liquid ejecting apparatus with reference to drawings. The liquid ejecting apparatus is, for example, an ink jet printer that performs recording (printing) by ejecting ink, which is an example of liquid, to a medium such as a sheet.

Figure 1:
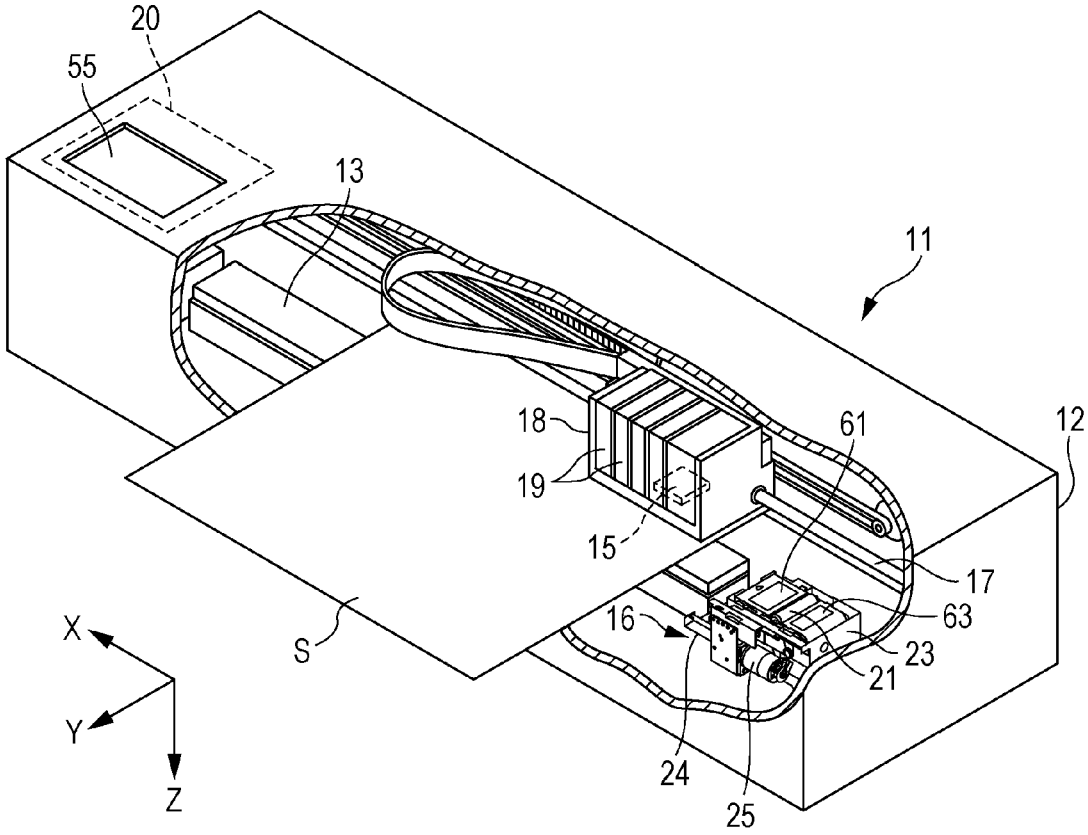
FIG. 1 is a perspective view schematically illustrating an embodiment of a liquid ejecting apparatus.

As illustrated in FIG. 1, a liquid ejecting apparatus 11 includes a case body 12, a medium support section 13 that supports a medium S in the case body 12, a liquid ejecting section 15 that includes nozzles 14 (see FIG. 2) capable of ejecting liquid to the medium S that is supported by the medium support section 13, and a maintenance device 16 that is for performing maintenance of the liquid ejecting section 15. In addition, a display section 55 such as a liquid crystal monitor is provided on an outer surface side of the case body 12.

In addition, the liquid ejecting apparatus 11 is provided with a control section 20 that is arranged at an arbitrary position in the case body 12 and controls the liquid ejecting section 15 and the maintenance device 16. The liquid ejecting section 15 performs recording (printing) by ejecting the liquid in an ejecting direction Z from the nozzles 14 to the medium S that is transported in a transport direction Y on the medium support section 13 in response to control by the control section 20.

The liquid ejecting section 15 is held by a carriage 18 that reciprocates along a guide section 17 extending in a moving direction X. One or more liquid accommodation bodies 19 that accommodate the liquid to be supplied to the liquid ejecting section 15 are detachably attached to the carriage 18. The moving direction X, the transport direction Y, and the ejecting direction Z are directions that intersect (preferably orthogonally intersect) each other. Since the ejecting direction Z is a direction that intersects the horizontal direction in this embodiment, the ejecting direction Z will be also referred to as a lower direction, and the opposite direction thereof will be also referred to as an upper direction.

A region, in which the medium support section 13 is arranged, in the case body 12 will be referred to as an ejection region, and a position at which the maintenance device 16 is arranged will be referred to as a maintenance region. The maintenance region is at a position located next to the ejection region in the moving direction X and is arranged outside (on the right side in FIG. 1) the ejection region. In this embodiment, the moving direction X is a direction from the maintenance region toward the ejection region.

Next, a detailed description will be given of a configuration of the maintenance device 16.

Figure 2:
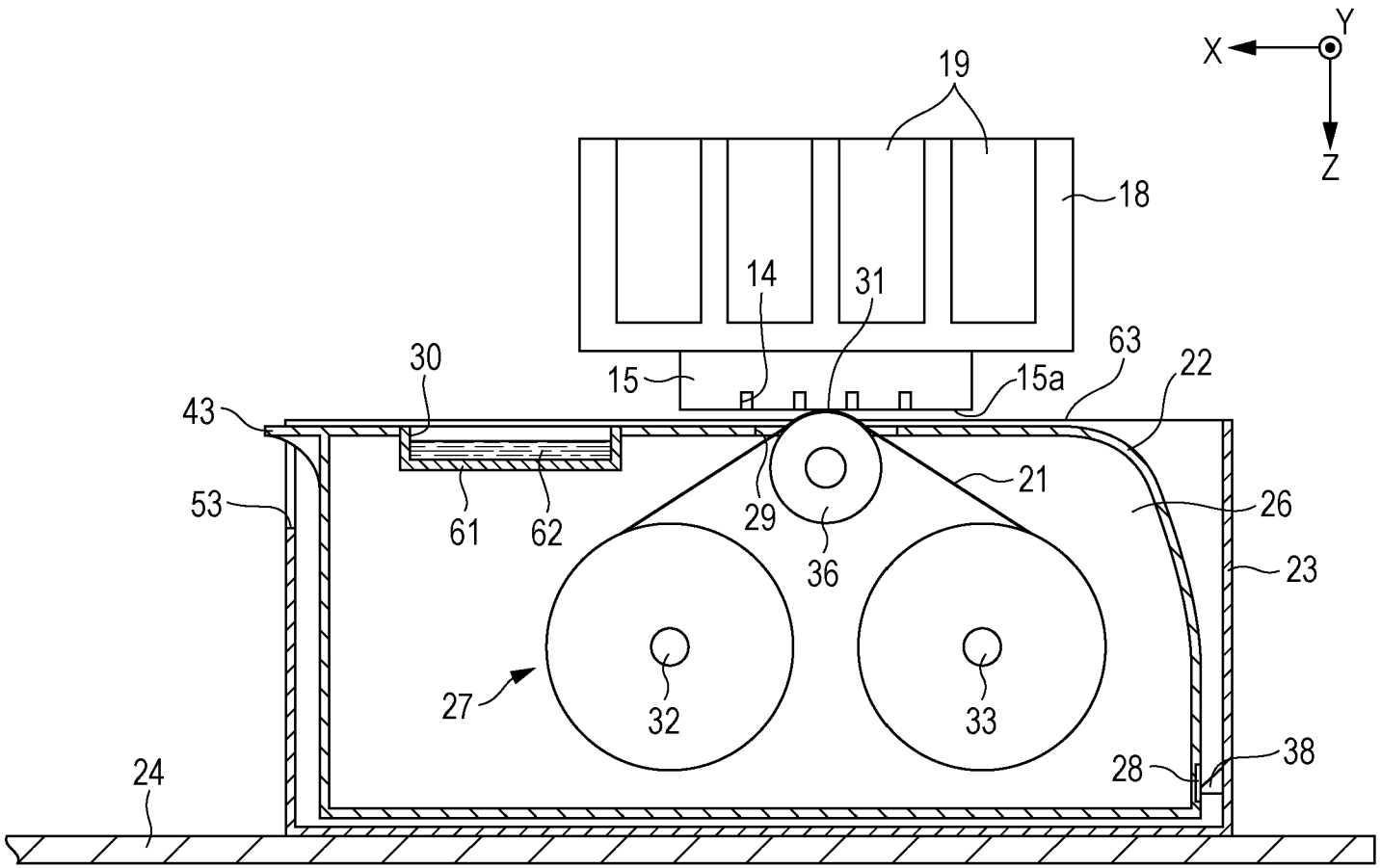
FIG. 2 is a cross-sectional view schematically illustrating an embodiment of a maintenance unit.

As illustrated in FIG. 2, the maintenance device 16 according to the embodiment is for causing the nozzles 14 to wipe an opening surface 15*a* in the liquid ejecting section 15 by using a long maintenance member 21, as a maintenance operation. The maintenance member 21 that is used for maintenance of the liquid ejecting section 15 is an absorption member that is made of non-woven fabric, for example, is capable of absorbing liquid, and is preferably impregnated with liquid for maintenance in advance. In addition, the opening surface 15*a* of the liquid ejecting section 15 is preferably provided with a liquid repellent film (water repellent film) for suppressing adhesion and sticking of the liquid.

As the impregnation liquid with which the absorption member is impregnated, a liquid that is selected in accordance with a type of liquid that is ejected by the liquid ejecting section 15 is used for the purpose of enhancing or maintaining a wiping property thereof. Here, examples of the liquid that is ejected by the liquid ejecting section 15 include water-based ink that is obtained by adding a coloring agent to a medium containing water as a main constituent and an organic solvent-based ink (also referred to as a non-water-based ink) that is obtained by adding a coloring agent to a medium configured of an organic solvent. As types of the ink, dye ink that employs water-soluble dye as a coloring agent and pigment ink that employs pigment as a coloring agent are exemplified. Furthermore, ink that is configured such that a medium in the ink that is landed on the medium S is gasified and a coloring agent therein is fixed to the medium, ink that is configured to be irradiated with UV or the like for fixation, and the like are exemplified.

In a case in which the liquid ejected by the liquid ejecting section 15 is pigment ink, for example, it is preferable to contain a penetrant for facilitating absorption of pigment particles into the absorption member and a moisturizer for suppressing evaporation of the impregnation liquid. In such a case, if the impregnation liquid is contained in the absorption member, the pigment particles easily move from the surface to the inside of the absorption member and tend not to remain on the surface of the absorption member.

A type of the impregnation liquid is not particularly limited as long as the liquid can move inorganic pigment particles from the surface to the inside of the absorption member. However, surface tension of the impregnation liquid is preferably equal to or less than 45 mN/m and is more preferably equal to or less than 35 mN/m. This is because low surface tension makes permeability of the inorganic pigment into the absorption member satisfactory and enhances the wiping property. As a method of measuring the surface tension, a method of measuring the surface tension by the Wilhelmy method at a liquid temperature of 25° C. by using a typically used surface tension meter (a surface tension meter CBVP-Z manufactured by Kyowa Interface Science Co., Ltd., for example) can be exemplified.

The content of the impregnation liquid is preferably equal to or greater than 10% by mass and equal to or less than 200% by mass, more preferably equal to or greater than 10% by mass and equal to or less than 120% by mass, and further preferably equal to or greater than 30% by mass and equal to or less than 100% by mass with respect to 100% by mass of the absorption member. If the content of the impregnation liquid is set to be equal to or greater than 10% by mass with respect to 100% by mass of the absorption member, it is possible to cause the inorganic pigment ink to easily penetrate through the absorption member, and as a result, it is possible to suppress the inorganic pigment with high hardness damaging the water repellent film that is provided on the opening surface 15*a*. If the content of the impregnation liquid is set to be equal to or less than 200% by mass with respect to 100% by mass of the absorption member, it is possible to further suppress remaining of the impregnation liquid on the opening surface 15*a* and to suppress dead pixels that are caused by entrance of air bubbles along with the impregnation liquid to the nozzles 14 and dead pixels that are caused by entrance of impregnation liquid itself to the nozzles 14.

As examples of an additive (constituent) that can be contained in the impregnation liquid, resin, an antifoaming agent, surfactant, water, an organic solvent, a pH adjuster, and the like are exemplified. Only one of these constituents may be added, two or more of these constituents may be added together, and content thereof can be arbitrarily changed.

If an antifoaming agent is added as an additive to the impregnation liquid, it is possible to effectively suppress foaming of the impregnation liquid remaining on the opening surface 15*a* after the wiping. In addition, there is a case in which the impregnation liquid contains a large amount of acid moisturizer such as polyethylene glycol or glycerin. In such a case, if the impregnation liquid contains a pH adjuster as an additive, it is possible to avoid contact between the acid impregnation liquid and an ink composition (typically, a basic composition of pH 7.5 or greater). In doing so, it is possible to suppress shift of the ink composition to the acid side and to thereby further maintain preservation stability of the ink composition.

As a moisturizer that can be contained in the impregnation liquid, any moisturizer can be used without any particular limitation as long as the moisturizer can be used with ink or the like in general. As the moisturizer, for example, it is possible to use a moisturizer that preferably has a boiling point that is as high as 180° C. or greater and more preferably has a boiling point that is as high as 200° C. or greater under 1 atm. If the boiling point of the moisturizer is within the aforementioned range, it is possible to suppress volatilization of a volatile constituent in the impregnation liquid and to thereby effectively perform the wiping by reliably moisturizing the inorganic pigment-containing ink composition that is brought into contact with the impregnation liquid.

Examples of the high-boiling-point moisturizer include ethylene glycol, propylene glycol, diethylene glycol, triethylene glycol, pentamethylene glycol, trimethylene glycol, 2-butene-1,4-diol, 2-ethyl-1,3-hexanediol, 2-methyl-2,4-pentanediol, tripropylene glycol, polyethylene glycol, polypropylene glycol, 1,3-propylene glycol, isopropylene glycol, isobutylene glycol, glycerin, mesoerythritol, and pentaerythritol.

One kind of moisturizer may be used alone, or two or more kinds of moisturizer may be mixed and used. The content of the moisturizer is preferably from 10% by mass to 100% by mass with respect to the total mass (100% by mass) of the impregnation liquid. The content of the moisturizer that is 100% by mass with respect to the total mass of the impregnation liquid means the impregnation liquid consists only of the moisturizer.

A description will be given of a penetrant among additives that can be contained in the impregnation liquid. Although any penetrant can be used without any particular limitation as long as the penetrant can be used with ink or the like in general, it is also possible to employ penetrant with which surface tension of a solution containing 90% by mass of water and 10% by mass of penetrant becomes equal to or less than 45 mN/m or less. The penetrant is not particularly limited, and examples of which include one or more kinds selected from a group consisting of alkanediols containing 5 to 8 carbon atoms, glycol ethers an acetylene glycol-based surfactant, a siloxane-based surfactant, and a fluorine-based surfactant. Measurement of the surface tension can be performed by the aforementioned method.

In addition, the content of the penetrant in the impregnation liquid is preferably equal to or greater than 1% by mass and equal to or less than 40% by mass and more preferably equal to or greater than 3% by mass and equal to or less than 25% by mass. If the content of the penetrant in the impregnation liquid is equal to or greater than 1% by mass, the wiping property tends to be more excellent. If the content thereof is equal to or less than 40% by mass, the penetrant attacks the pigment contained in the ink in the vicinity of the nozzles, and it is possible to avoid degradation of dispersion stability and occurrence of aggregation.

The alkanediols containing 5 to 8 carbon atoms are not particularly limited, and examples thereof include 1,2-pentanediol, 1,5-pentanediol, 1,2-hexanediol, 1,6-hexanediol, 1,2-heptanediol, 2-ethyl-1,3-hexanediol, 2,2-dimethyl-1,3-propanediol, and 2,2-dimethyl-1,3-hexanediol. One kind of alkanediols containing 5 to 8 carbon atoms may be used alone, or two or more kinds thereof may be used together.

The glycol ethers are not particularly limited, and examples thereof include ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethylmethyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, ethylene glycol mono-isohexyl ether, diethylene glycol mono-isohexyl ether, triethylene glycol mono-isohexyl ether, ethylene glycol mono-isoheptyl ether, diethylene glycol mono-isoheptyl ether, triethylene glycol mono-isoheptyl ether, ethylene glycol mono-isooctyl ether, diethylene glycol mono-isooctyl ether, triethylene glycol mono-isooctyl ether, ethylene glycol mono-2-ethylhexyl ether, diethylene glycol mono-2-ethylhexyl ether, triethylene glycol mono-2-ethylhexyl ether, diethylene glycol mono-2-ethylpentyl ether, ethylene glycol mono-2-ethylpentyl ether, ethylene glycol mono-2-methylpentyl ether, and diethylene glycol mono-2-methylpentyl ether. One kind of glycol ethers may be used alone, or two or more kinds thereof may be used together.

The acetylene glycol-based surfactant is not particularly limited, and compounds represented by the following formula are exemplified.

(1)

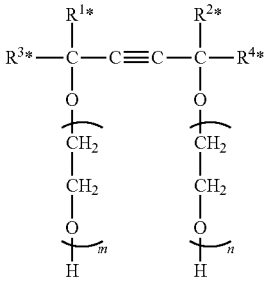

In Formula (1), $0 \leq m+n \leq 50$, $R^{1*}$, $R^{2*}$, $R^{3*}$, and $R^{4*}$ each independently represent an alkyl group (preferably an alkyl group containing 1 to 6 carbon atoms).

Among the acetylene glycol-based surfactants represented by Formula (1), preferable examples include 2,4,7,9-tetramethyl-5-decine-4,7-diol, 3,6-dimethyl-4-octine-3,6-diol, and 3,5-dimethyl-1-hexine-3-ol. It is also possible to use commercially marketed surfactants as the acetylene glycol-based surfactants that are represented by Formula (1), and specific examples thereof include Surfynols 82, 104, 440, 465, and 485 and TG (all of which are available from Air Products and Chemicals, Inc.), and Olfine STG and Olfine E1010 (product names) (manufactured by Nissin Chemical Industry Co., Ltd.). One kind of the acetylene glycol-based surfactants may be used alone, or two or more kinds thereof may be used together.

The siloxane-based surfactant is not particularly limited, and examples thereof include compounds represented by the following Formula (2) or (3).

(2)

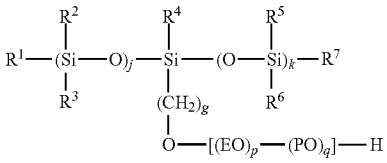

In Formula (2), $R^1$, $R^2$, $R^3$, $R^4$, $R^5$, $R^6$, and $R^7$ each independently represent an alkyl group containing 1 to 6 carbon atoms, and preferably represent a methyl group. j and k independently represent an integer that is equal to or greater than 1, is preferably from 1 to 5, is more preferably from 1 to 4, and is further preferably from 1 or 2, and it is preferable that j=k=1 or k=j+1 is satisfied. g represents an integer that is equal to or greater than 0, is preferably from 1 to 3, and is more preferably 1. Furthermore, p and q each represent an integer that is equal to or greater than 0, and are preferably from 1 to 5. However, p+q is an integer that is equal to or greater than 1, and it is preferable that p+q is from 2 to 4.

As the siloxane-based surfactants represented by Formula (2), compounds in which all of $R^1$ to $R^7$ represent a methyl group, j represent 1 or 2, k represent 1 or 2, g represent 1 or 2, p represent an integer that is equal to or greater than 1 and equal to or less than 5, and q is 0 are preferably used.

(3)

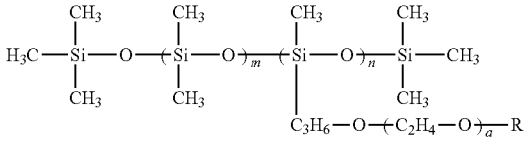

In Formula (3), R represents a hydrogen atom or a methyl group, a represents an integer from 2 to 18, m represents an integer from 0 to 50, and n represents an integer from 1 to 5.

The siloxane-based surfactants represented by Formula (3) are not particularly limited, preferable examples thereof include compounds in which R represents a hydrogen atom or a methyl group, a represents an integer from 7 to 11, m represents an integer from 30 to 50, and n represents an integer from 3 to 5, compounds in which R represents a hydrogen atom or a methyl group, a represents an integer from 9 to 13, m represents an integer from 2 to 4, and n represents an integer 1 or 2, compounds in which R represents a hydrogen atom or a methyl group, a represents an integer from 6 to 18, m represents an integer 0, and n represents an integer 1, and compounds in which R represents a hydrogen atom, a represents an integer from 2 to 5, m represents an integer from 20 to 40, and n represents an integer from 3 to 5.

Commercially available and commercially marketed siloxane-based surfactant may be used, and for example, it is possible to use Olfine PD-501 (manufactured by Nissin Chemical Industry Co., Ltd.), Olfine PD-570 (manufactured by Nissin Chemical Industry Co., Ltd.), BYK-347 (manufactured by BYK Japan KK.) or BYK-348 (manufactured by BYK Japan KK.). One kind of the siloxane-based surfactants may be used alone, or two or more kinds thereof may be used together.

The fluorine-based surfactant has been known as a solvent that exhibits satisfactory wettability with respect to a low-absorbable or non-absorbable recording medium as disclosed in International Publication No. WO2010/050618 and International Publication No. WO2011/007888. The fluorine-based surfactant is not particularly limited and can be appropriately selected. Examples thereof include perfluoroalkylsulphonate, perfluoroalkylcarbonate, perfluoroalkyl phosphoric acid ester, a perfluoroalkyl ethylene oxide adduct, perfluoroalkylbetaine, and a perfluoroalkylamine oxide compound.

In addition to the above examples, an appropriately synthesized fluorine-based surfactant may be used, or a commercially available fluorine-based surfactant may be used. Examples of the commercially marketed product include S144 and S145 (manufactured by Asahi Glass Co., Ltd.); FC170C, FC430, Fluorad FC4430 (manufactured by Sumitomo 3M Ltd.); FSO, FSO100, FSN, FSN100, FS300 (manufactured by DuPont KK.), and FT250 and FT251 (manufactured by NEOS Company Limited). Among the examples, FSO, FSO100, FSN, FSN100, and FS300 manufactured by DuPont KK. are preferably used. One kind of the fluorine-based surfactants may be used alone, or two or more kinds thereof may be used together.

In a case in which the liquid ejected by the liquid ejecting section 15 is a solvent-based ink that is a non-water-based ink, the impregnation liquid with which the absorption member is impregnated preferably contains at least one kind of organic solvent (hereinafter, also referred to as a "specific organic solvent") selected from a group consisting of the compounds represented by the following Formula (I), esters, and dibasic acid esters. One kind of these specific organic solvents may be used alone, or two or more kinds thereof may be used together.

Since the specific organic solvents have an excellent effect of dissolving (softening) the non-water-based ink that adheres to the opening surface 15*a*, efficiency of wiping the opening surface 15*a* is enhanced by suppressing aggregation of constituents included in the non-water-based ink.

$$R^1—O—(R^2—O)n\text{-}R^3 \quad (I)$$

In Formula (I), $R^1$ represents a hydrogen atom, an aryl group, or an alkyl group containing 1 to 6 carbon atoms, $R^2$ represents an alkylene group containing 2 to 4 carbon atoms, $R^3$ represents an aryl group or an alkyl group containing 1 to 6 carbon atoms, and n represents an integer that is equal to or greater than 1 and equal to or less than 9. Examples of the "aryl group" include a phenyl group, benzyl group, a tolyl group, a xylyl group, a naphtyl group, a methyl naphtyl group, a benzyl phenyl group, and a biphenyl group. As the "alkyl group containing 1 to 6 carbon atoms", it is possible to exemplify a linear or branched alkyl group. Examples thereof include a methyl group, an ethyl group, an n-propyl group, iso-propyl group, n-butyl group, a sec-butyl group, a tert-butyl, a pentyl group, and a hexyl group. Examples of the "alkylene group containing 2 to 4 carbon atoms" include an ethylene group, an n-propylene group, an isopropylene group, and a butylene group.

In Formula (I), $R^1$ is preferably a hydrogen atom or an alkyl group containing 2 to 4 carbon atoms. In Formula (I), $R^3$ is preferably an alkyl group containing 2 to 4 carbon atoms. In doing so, the effect of dissolving (softening) the non-water-based ink is enhanced, and further satisfactory wiping efficiency can be achieved.

In Formula (I), n is preferably an integer that is equal to or greater than 3 and equal to or less than 6. In doing so, the effect of dissolving (softening) the non-water-based ink, and further satisfactory wiping efficiency can be achieved.

Specific examples of the compounds represented by Formula (I) include glycol ethers such as an alkylene glycol monoether and an alkylene glycol diether. One kind of glycol ethers may be used alone, or two or more kinds thereof may be mixed and used.

Examples of alykylene glycol monoether include ethylene glycol monomethyl ether, ethylene glycol monoethyl ether, ethylene glycol mono-isopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, diethylene glycol monobenzyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, pentaethylene glycol monomethyl ether, pentaethylene glycol monoethyl ether, pentaethylene glycol monobutyl ether, propylene glycol monomethyl ether, propylene glycol monoethyl ether, dipropylene glycol monomethyl ether, and dipropylene glycol monoethyl ether.

Examples of alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether.

As esters (R—CO—OR'), it is possible to exemplify an organic solvent in which R represents a hydrogen atom, an alkyl group, an aryl group, or a glycol ether group, and R' represents an alkyl group or an aryl group. As such esters, it is preferable to use glycol ether esters, and examples thereof include ethylene glycol monomethyl ether acetate, ethylene glycol monoethyl ether acetate, ethylene glycol monopropyl ether acetate, ethylene glycol monobutyl ether acetate, propylene glycol monomethyl ether acetate, propylene glycol monoethyl ether acetate, propylene glycol monopropyl ether acetate, propylene glycol monobutyl ether acetate, dimethylene glycol monomethyl ether acetate, dimethylene glycol monoethyl ether acetate, dimethylene glycol monopropyl ether acetate, dimethylene glycol monobutyl ether acetate, diethylene glycol monomethyl ether acetate, diethylene glycol monoethyl ether acetate, diethylene glycol monopropyl ether acetate, diethylene glycol monobutyl ether acetate, dipropylene glycol monomethyl ether acetate, dipropylene glycol monoethyl ether acetate, dipropylene glycol monopropyl ether acetate, dipropylene glycol monobutyl ether acetate, trimethylene glycol monomethyl ether acetate, trimethylene glycol monoethyl ether acetate, trimethylene glycol monopropyl ether acetate, trimethylene glycol monobutyl ether acetate, triethylene glycol monomethyl ether acetate, triethylene glycol monoethyl ether acetate, triethylene glycol monopropyl ether acetate, triethylene glycol monobutyl ether acetate, tripropylene glycol monomethyl ether acetate, tripropylene glycol monoethyl ether acetate, tripropylene glycol monopropyl ether acetate, tripropylene glycol monobutyl ether acetate, 3-methoxybutyl acetate, and 3-methoxy-3-methyl-1-butyl acetate.

As dibasic acid esters, it is possible to exemplify monoester and diester of dicarboxylic acid (for example, aliphatic dicarboxylic acid such as glutaric acid, adipic acid, or succinic acid). Specific examples thereof include dimethyl-2-methyl glutarate.

Among the specific organic solvents, it is preferable to use the compounds represented by Formula (I) in terms of the excellent effect of dissolving (softening) the non-water-based ink.

As the specific organic solvents, it is preferable to use organic solvents with a standard boiling point of equal to or greater than 170° C., and it is more preferable to use organic solvents with a standard boiling point of equal to or greater than 250° C. In doing so, it is possible to reduce clogging of the nozzles 14 that is occurred when the impregnation liquid dries and to thereby achieve satisfactory ejection stability of the non-water-based ink.

As the specific organic solvents, it is preferable to use organic solvents with a vapor pressure of equal to or less than 1 hPa, and it is more preferable to use organic solvents with a vapor pressure of equal to or less than 0.5 hPa, it is further preferable to use organic solvents with a vapor pressure of equal to or less than 0.1 hPa, and it is particularly preferable to use organic solvents with a vapor pressure of equal to or less than 0.01 hPa at 20° C. In doing so, it is possible to reduce clogging of the nozzles 14 that is caused when the impregnation liquid is dried and to thereby achieve satisfactory ejection stability of the non-water-based ink.

As the specific organic solvents, it is preferable to use organic solvents with surface tension of equal to or greater than 25 mN/m and equal to or less than 35 mN/m at 20° C. In doing so, compatibility with the non-water-based ink, which will be described later, is enhanced. Therefore, the wiping efficiency tends to be further enhanced. In addition, it is possible to measure the surface tension by checking surface tension when a platinum plate is moistened with the organic solvents in an environment at 20° C. by using an automatic surface tension meter CBVP-Z (manufactured by Kyowa Interface Science Co., Ltd.).

As for the content of the specific organic solvents, the lower limit thereof is preferably equal to or greater than 30% by mass and is more preferably equal to or greater than 50% by mass with respect to the total mass (100% by mass) of the impregnation liquid. If the content of the specific organic solvents is equal to or greater than 50% by mass, the efficiency of wiping the opening surface 15*a* is further enhanced. The upper limit of the content of the specific organic solvents with respect to the impregnation liquid is not limited and may be 100% by mass.

In a case of performing the wiping by using the absorption member that holds the impregnation liquid, it is preferable that the impregnation liquid with which the absorption member is impregnated preferably contains 10 parts by mass or more of the specific organic solvents, more preferably contains 15 parts by mass or more of the specific organic solvents, further preferably contains 20 parts by mass or more of the specific organic solvents, further preferably contains 40 parts by mass or more of the specific organic solvents, and particularly preferably contains 50 parts by mass of the specific organic solvents with respect to 100 parts by mass of the absorption member. The upper limit thereof is preferably equal to or less than 150 parts by mass and is more preferably equal to or less than 100 parts by mass. If the content thereof is equal to or greater than 10 parts by mass, it is possible to easily dissolve (soften) the ink solidified on the opening surface 15*a* and to thereby further enhance the wiping efficiency. If the content thereof is equal to or less than 150 parts by mass, it is possible to easily cause the absorption member to absorb the ink. Therefore, abnormal ejection and ejection failures of the nozzles 14 due to ink remaining after the wiping do not occur easily, and satisfactory ink ejection stability can be achieved.

In addition, the impregnation liquid with which the absorption member is impregnated may contain an organic solvent other than the aforementioned specific organic solvents and may further contain substances for adding predetermined performances, such as a surfactant, a pH adjuster, a chelator, an antiseptic agent, a fungicide, and a rust inhibitor in a case in which the liquid that is ejected by the liquid ejecting section 15 is a solvent-based ink.

As illustrated in FIG. 1, the maintenance device 16 is provided with a box-shaped attachment section 23 to which the maintenance unit 22 including a maintenance member 21 is detachably attached and a drive mechanism 25 that causes the attachment section 23 to reciprocate in the moving direction X along a guide frame 24.

As illustrated in FIG. 2, the maintenance unit 22 is provided with a holding section 27 that holds the maintenance member 21 in an accommodation section 26 in a movable state, the accommodation section 26 that accommodates the holding section 27, a liquid receiving section 61 that is formed into a concave shape, and a recording target section 63 (also see FIG. 1) that is arranged on a top surface 26*t* of the accommodation section 26. A liquid absorbing material 62 that is capable of absorbing liquid is accommodated in the liquid receiving section 61. The liquid receiving section 61 is a component of the maintenance section according to the embodiment.

The recording target section 63 may be a label, which is attached to the accommodation section 26, for example, on which recording (printing) can be performed, or a simple space for recording may be provided as the recording target section 63 on the top surface 26*t* of the accommodation section 26 as long as the top surface 26*t* is made of a recordable material.

The maintenance unit 22 may be provided with a storage medium 28 on which information related to the maintenance member 21 is stored. In such a case, a connection terminal 38 configured of a plate sprig or the like is arranged at a position, at which the connection terminal 38 can be brought into contact with a connection portion of the storage medium 28 of the maintenance unit 22 that is attached to the attachment section 23, in the attachment section 23. The connection terminal 38 is electrically connected to the control section 20 (see FIG. 1). If the connection terminal 38 is brought into contact with the connection portion of the storage medium 28 of the maintenance unit 22 that is attached to the attachment section 23, the control section 20 reads information stored on the storage medium 28 via the connection terminal 38 or write information in the storage medium 28.

The accommodation section 26 includes opening sections 29 and 30 provided in the top surface 26*t*, one end of the maintenance member 21 is exposed through the opening section 29, and the liquid receiving section 61 is exposed through the opening section 30. In the following description, a portion, which is exposed from the opening section 29, of the maintenance member 21 will be referred to as a wiping section 31. The wiping section 31 is a component of the maintenance section according to the embodiment.

The holding section 27 is provided with a feeding roller 32 around which a portion of the maintenance member 21 on a base end side is wound, a winding roller 33 around with a portion of the maintenance member 21 on a leading end side that is fed by rotation of the feeding roller 32 is wound, and a stretch roller 36, which is positioned between the feeding roller 32 and the winding roller 33, around which the maintenance member 21 is stretched.

The stretch roller 36 is arranged such that a part of a circumferential surface thereof project from the opening section 29 of the accommodation section 26. Therefore, a part of the maintenance member 21, which is stretched around the stretch roller 36, is made to function as the wiping section 31. In addition, the wiping section 31 arranged at the opening section 29 is sequentially replaced with an unused portion by the maintenance member 21 moving with the rotation of the feeding roller 32 and the winding roller 33.

In a case in which no more maintenance member 21 cannot be fed as a result of the movement of the maintenance member 21 with the rotation of the feeding roller 32 and the winding roller 33, it is considered that the maintenance unit 22 has been consumed by usage, and the maintenance unit 22 is replaced with a new maintenance unit 22. That is, the maintenance unit 22 after usage is detached from the attachment section 23, and another maintenance unit 22 before usage is attached to the attachment section 23.

Figure 3:
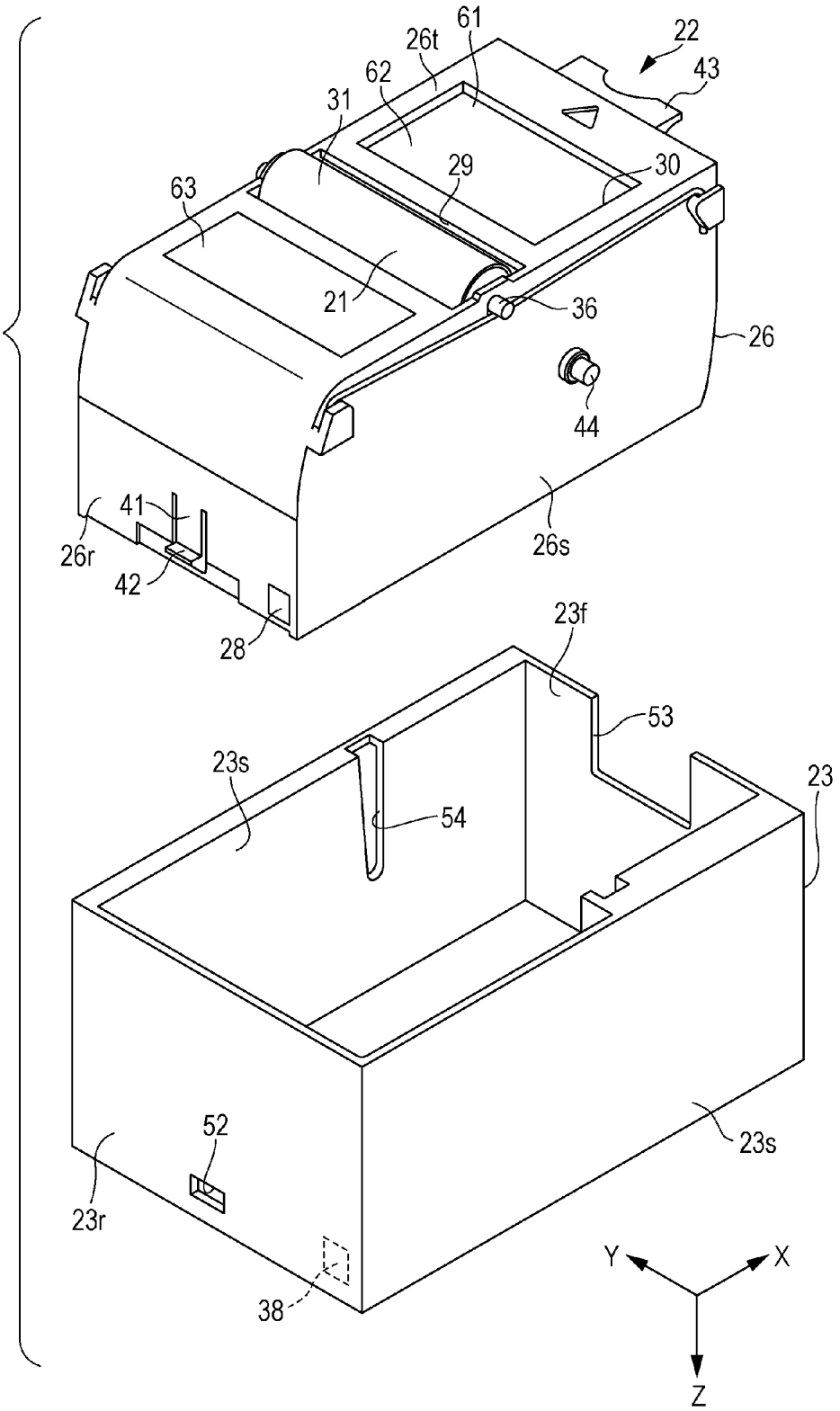
FIG. 3 is a perspective view of the maintenance unit to be attached to an attachment section when viewed from a direction.
Figure 4:
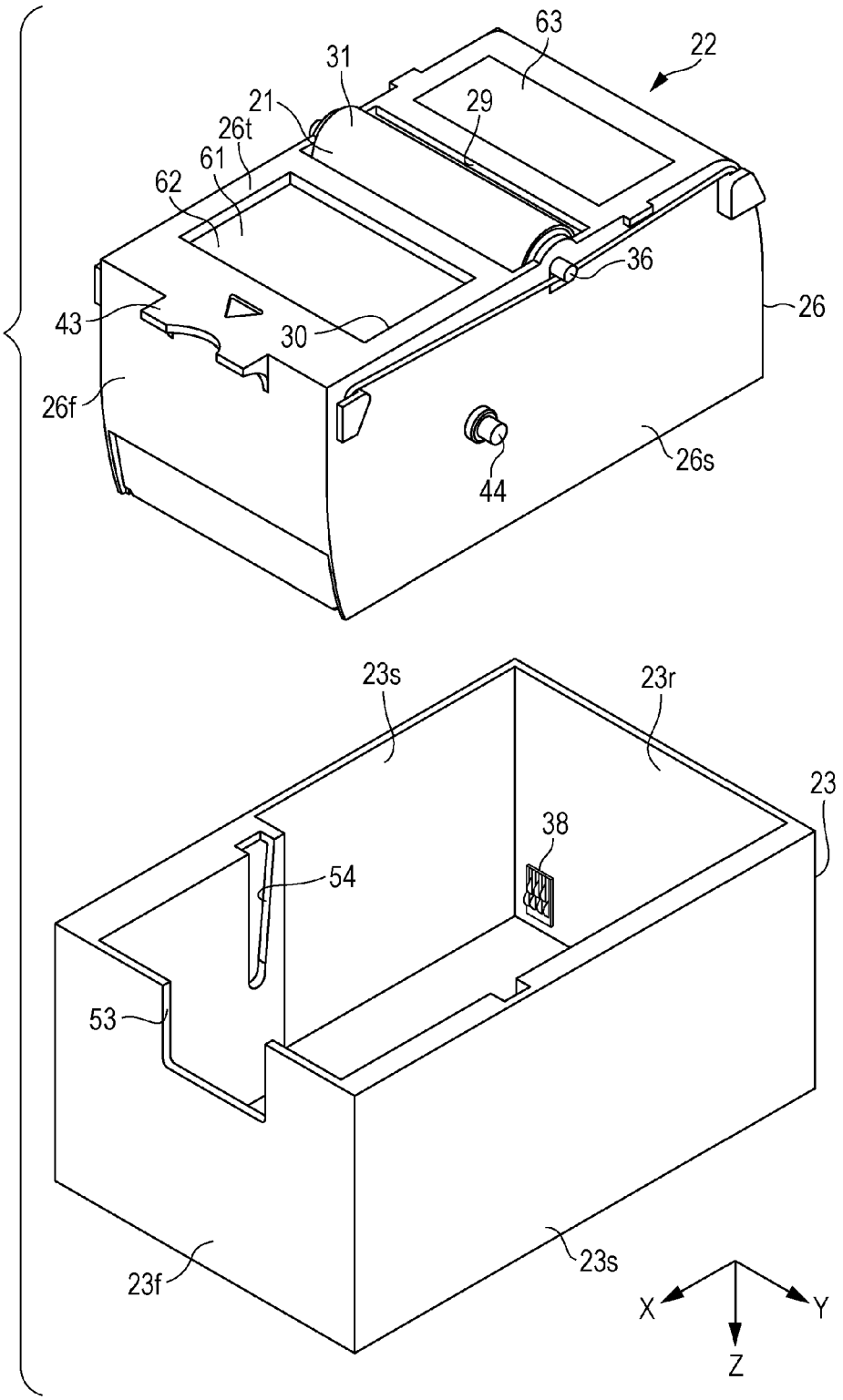
FIG. 4 is a perspective view of the maintenance unit to be attached to the attachment section when viewed from another direction.

As illustrated in FIGS. 3 and 4, the accommodation section 26 has a longitudinal direction in the moving direction X, and the wiping section 31 and the opening section 29 are arranged to have the longitudinal directions in the transport direction Y around the center of the accommodation section 26 in the longitudinal direction, in the maintenance unit 22.

In the embodiment, one end side (the side represented by a triangular mark in the top surface 26*t*) of the accommodation section 26 beyond the opening section 29 in the longitudinal direction will be referred to as a leading end side, and the other end side (the side on which the top surface 26*t* is formed into a curved surface) beyond the opening section 29 in the longitudinal direction will be referred to as a base end side. In addition, a surface of a leading end of the accommodation section 26, which intersects the top surface 26*t*, will be referred to as a leading end surface 26*f*, a surface of a base end which intersects the top surface 26*t* will be referred to as a base end surface 26*r*, and surfaces which intersect the top surface 26*t*, the leading end surface 26*f*, and the base end surface 26*r* will be referred to as side surfaces 26*s*. Moreover, the recording target section 63, the wiping section 31, and the liquid receiving section 61 are aligned in this order in the longitudinal direction from the base end toward the tip end on the top surface 26*t* of the accommodation section 26.

In contrast, a wall section, which faces the leading end surface 26*f* when the maintenance unit 22 is attached, of the attachment section 23 will be referred to as a front wall 23*f*, a wall section which faces the base end surface 26*r* will be referred to as a rear wall 23*r*, and wall sections which face the side surfaces 26*s* will be referred to as side walls 23*s*.

An elastic piece section 41 that has an end fixed to the accommodation section 26 on an upper end side and a free end on a lower end side is provided at a position, which is near the lower side, on the base end surface 26*r* of the accommodation section 26. The elastic piece section 41 can be elastically deformed in the moving direction X by using the fixed end on the upper end side as a support point. In addition, a locking claw 42 is provided at the free end of the elastic piece section 41 on the lower side so as to project outward.

In contrast, a hook hole 52 with which the locking claw 42 of the elastic piece section 41 can be locked is formed at a position, which is closed to the lower side, in the rear wall 23*r* of the attachment section 23. In a case in which the maintenance unit 22 is attached to the attachment section 23, separation of the maintenance unit 22 from the attachment section 23 is suppressed by the locking claw 42 of the maintenance unit 22 being locked with the hook hole 52 of the attachment section 23.

A finger grip section 43 that projects in a direction toward the leading end from the top surface 26*t* is provided at the upper end of the leading end surface 26*f* of the accommodation section 26. The finger grip section 43 is used by a user to hook their fingers for removing the maintenance unit 22 from the attachment section 23.

In contrast, a notch section 53 is formed at the upper end of the front wall 23*f* of the attachment section 23. In a case in which the maintenance unit 22 is attached to the attachment section 23, the finger grip section 43 of the maintenance unit 22 is exposed to the outside of the attachment section 23 through the notch section 53 (see FIG. 2).

An engagement projection 44 with substantially a cylindrical shape is provided in each of both side surfaces 26*s* of the accommodation section 26 so as to project at a position that is slightly closer to the leading end beyond the center in the longitudinal direction and that is near substantially the center in the vertical direction (ejecting direction Z).

In contrast, a guide groove 54 that extends to the vicinity of the center in the vertical direction from the upper end toward the lower side is provided at each of the inner portions of both the side walls 23*s* of the attachment section 23 at a location that is slightly closer to the leading end beyond the center in the longitudinal direction. It is preferable that the width of an opening at an upper end of the guide groove 54 is set to be slightly larger than the diameter of the engagement projection 44 and the groove width is gradually narrowed toward the lower side. When the maintenance unit 22 is attached to the attachment section 23, the maintenance unit 22 is accommodated at an appropriate position in the attachment section 23 by the engagement projection 44 of the maintenance unit 22 being guided to the guide groove 54.

Next, a description will be given of wiping as a maintenance operation performed by the maintenance device 16.

If liquid droplets with a predefined size are ejected from the nozzles 14 in the liquid ejecting apparatus 11 for printing, mist configured of liquid droplets that are finer than the liquid droplets with the predefined size is collaterally generated. If such mist adheres to the circumference of the nozzles 14, gradually increases in size, and forms liquid droplets, the liquid droplets with the increased size are brought into contact with the liquid droplets that are ejected from the nozzles 14, change a flying direction of the ejected liquid droplets, and degrade printing quality in some cases.

Thus, the carriage 18 moves to the maintenance region, and the maintenance device 16 performs wiping by using the maintenance member 21 after a predetermined number of copies are printed or after printing is performed for a predetermined period of time. Specifically, the wiping section 31 wipes the surface on which the nozzles 14 of the liquid ejecting section 15 open by moving the attachment section 23 to which the maintenance unit 22 is attached in the moving direction X in response to the drive by the drive mechanism 25 (see FIG. 2).

If an operation of discharging liquid from the nozzles 14 of the liquid ejecting section 15 is executed as a maintenance operation while the carriage 18 is moved to the maintenance region in the liquid ejecting apparatus 11, there is a case in which the liquid discharged from the nozzles 14 adheres to the opening surface 15*a*. In such a case, the maintenance device 16 performs the aforementioned wiping by using the maintenance member 21.

In doing so, the mist that has adhered to the liquid ejecting section 15 and the liquid that has adhered to the opening surface 15*a* while the liquid discharge operation is performed are absorbed by the maintenance member 21, and foreign maters, such as paper powder, which have adhered to the liquid ejecting section 15 are wiped off by the maintenance member 21. If the wiping of the liquid ejecting section 15 is completed, the feeding roller 32 and the winding roller 33 are rotated to move the maintenance member 21, and the wiping section 31 that is arranged at the opening section 29 is replaced with an unused portion.

By rotating the feeding roller 32 and the winding roller 33 to move the maintenance member 21 when the attachment section 23 moves in the moving direction X and the wiping section 31 is in contact with the liquid ejecting section 15, it is possible to enhance the wiping performance of the wiping section 31.

Next, a description will be given of flushing that is one of maintenance operations.

Flushing is an operation of ejecting liquid droplets, which do not have any relationship with printing, from the liquid ejecting section 15 toward the liquid receiving section 61 in order to solve or prevent clogging of the nozzles 14 or liquid droplet ejection failures that are caused due to entrance of fine air bubbles into the nozzles 14.

Such flushing is performed at a predetermined timing, and for example, the flushing is performed before and after printing or during printing. If wiping is performed, there is a concern that air bubbles or foreign matters are pressed into the nozzles 14 by the wiping section 31 and meniscus (curved liquid surfaces in the nozzles 14) is disordered. Therefore, it is preferable to fix the meniscus by performing the flushing to discharge the foreign matters and the like from the nozzles 14 after execution of the wiping.

Next, a description will be given of information that is stored on the storage medium 28.

The storage medium 28 stores at least one kind of the following information.

(1) A value corresponding to the number of times the maintenance is executed (2) A value corresponding to the amount of movement of the maintenance member 21 during wiping (3) Information related to the liquid ejecting apparatus to which the maintenance unit 22 is attached (4) Information related to a date on which the maintenance unit 22 is attached to the liquid ejecting apparatus (5) Information related to a fabrication data of the maintenance unit 22

(6) Information related to the liquid ejecting apparatus to which the maintenance unit 22 can be attached (7) information related to liquid with which the maintenance member 21 is impregnated Hereinafter, descriptions will be given of the aforementioned information, respectively.

(1) is information related to a usage history of the maintenance unit 22, and is an accumulated number of times that the wiping or flushing is performed, for example. Alternatively, if the number of times of maintenance that can be executed until it becomes impossible to use the maintenance unit 22 is set as a number of times until life duration ends, (1) is a rate of the number of times of execution with respect to the number of times until life duration ends, or a number of times remaining before life duration ends.

(2) is information related to a usage history of the maintenance unit 22, and is a number of times that the maintenance member 21 is moved for wiping, a number of rotations of the feeding roller 32 or the winding roller 33, or an accumulated value of the length of the maintenance member 21 that passes through a predetermined measurement position, for example. Alternatively, (2) is a rate of a moving distance with respect to the entire length of the maintenance member 21, a length of the remaining unused portion, or a rate of the length of the remaining unused portion with respect to the entire length of the maintenance member 21.

(3) is information related to a usage history of the maintenance unit 22, and is information that is preferably stored on the storage medium 28 in a case in which one maintenance unit 22 is shared by a plurality of different liquid ejecting apparatuses, in particular. In addition, the storage medium 28 stores information for specifying a type of the attached liquid ejecting apparatus and a type of the liquid that is ejected by the liquid ejecting apparatus as information related to the liquid ejecting apparatus to which the maintenance unit 22 is attached every time one maintenance unit 22 is attached to the liquid ejecting apparatus.

(4) is information related to a usage history of the maintenance unit 22, and may be a date on which the maintenance unit 22 is attached to the liquid ejecting apparatus first, for example. In a case in which a validity date is set for the maintenance unit 22, (4) may be a date remaining until the validity date after the maintenance unit 22 is attached to the liquid ejecting apparatus first.

(5) may be a fabrication date of the maintenance unit 22, or in the case in which a validity date is set for the maintenance unit 22, (5) may be a date remaining until the validity date from the fabrication date.

(6) is preferably stored as a type of the ejected liquid, the impregnation liquid, or the liquid ejecting apparatus on the storage medium 28 in a case in which usage with a specific liquid ejecting section is not appropriate depending on a material of the maintenance member 21, a type of the impregnation liquid with which the maintenance member 21 as the absorption member is impregnated, and the like, in particular.

Since impregnation liquid that has a characteristic suitable for the liquid to be ejected by the liquid ejecting section 15 is selected, it is not preferable that such impregnation liquid adheres to the liquid ejecting section 15 that ejects a different kind of liquid. A composition of the impregnation liquid is optimally designed in accordance with a composition of the ink used. Therefore, if incompatible impregnation liquid adheres to the liquid ejecting section 15 using ink, a combination with which has not been expected, via the maintenance member 21 that has been previously used, there may be a case in which foreign matters are precipitated from the ink that has been in contact with the impregnation liquid.

Then, there is a concern that the precipitated foreign matters stick to the opening surface 15*a* and it becomes not possible to wipe off the foreign matters, or there is a concern that the water repellent film of the opening surface 15*a* is damaged by wiping the opening surface 15*a* in a state in which the precipitated foreign mattes adhere thereto. Particularly, a pigment that is stably dispersed is used in pigment ink in accordance with a type of a medium (a water-based medium or an organic solvent-based medium). Therefore, if the pigment is mixed with a different type of medium, the pigment is precipitated or solidified, and foreign matters are easily generated.

(7) is preferably stored on the storage medium 28 in a case in which it is not appropriate to use the impregnation liquid, with which the maintenance member 21 is impregnated, with a specific liquid ejecting section 15 as described above in (6). In a case in which a validation date or a number of times until life duration ends is set for the maintenance unit 22 based on how easily the liquid, with which the maintenance member 21 is impregnated, is evaporated and how easily properties thereof vary, a number of days remaining until the validity date or a remaining number of times may be stored on the storage medium 28.

An entirety or a part of the information (1) to (7) is recorded (printed) on the recording target section 63 as information related to the maintenance section in a visibly recognizable manner by the liquid ejecting section 15. Information (3) and (4) is recorded on the recording target section 63 when the maintenance unit 22 is attached to the liquid ejecting apparatus 11, for example. Alternatively, information (1) and (2) is recorded on the recording target section 63 at a timing before the maintenance unit 22 is detached from the liquid ejecting apparatus 11. In addition, information (1), (2), and (5) to (7) may be read from the storage medium 28 and may be recorded on the recording target section 63.

In addition to or instead of the information (1) to (7), information related to a date on which the maintenance unit 22 is detached from the liquid ejecting apparatus 11 may be recorded on the recording target section 63 at a timing before the maintenance unit 22 is detached from the liquid ejecting apparatus 11. The timing at which such information is recorded on the recording target section 63 and which of the information is to be recorded may be set in advance or may be arbitrarily set by the user later.

Figure 5:
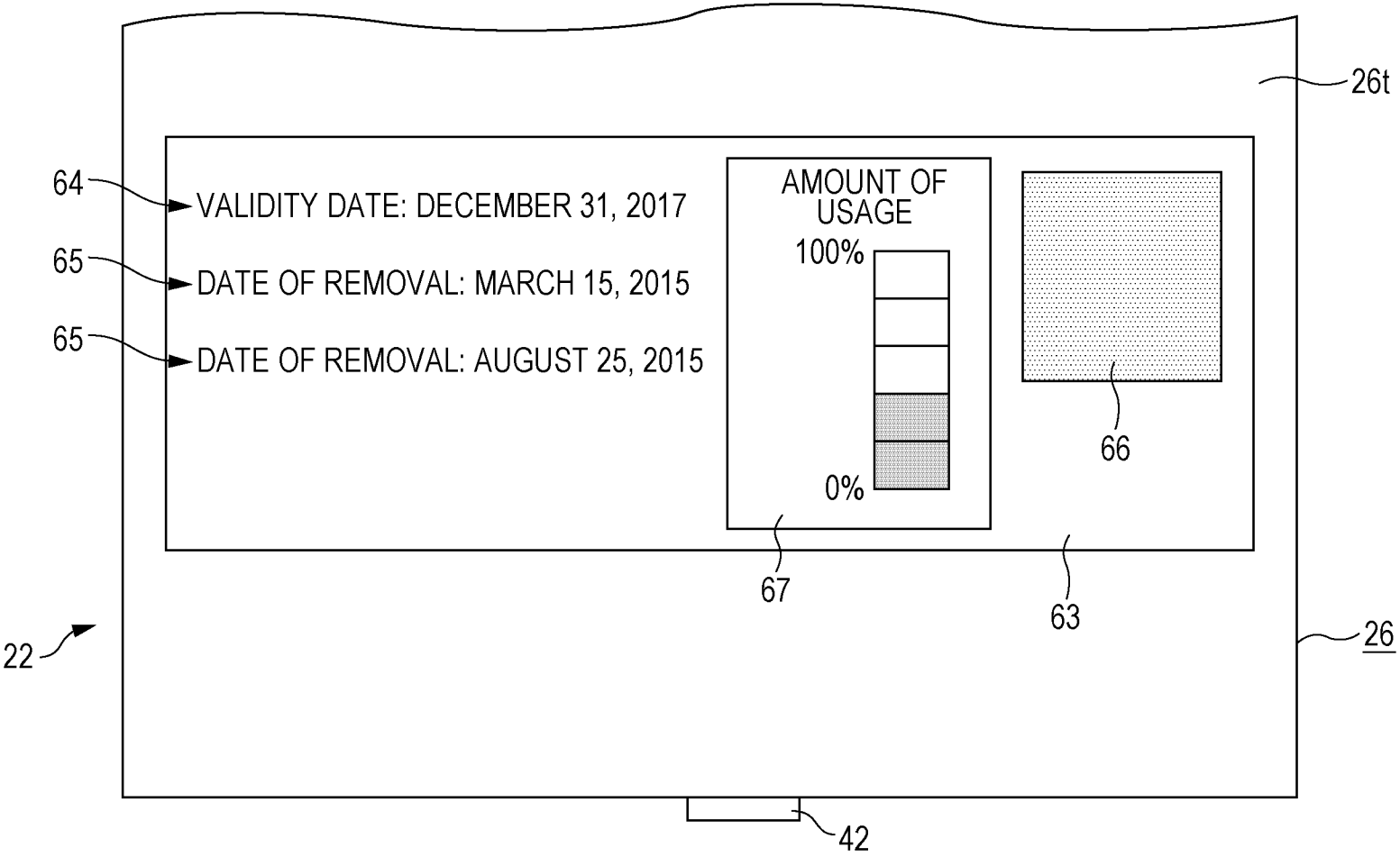
FIG. 5 is a top view illustrating a recording target section.

In a case in which the information related to a usage history of the maintenance section is recorded on the recording target section 63 as illustrated in FIG. 5, a usage amount display section 67 that displays an amount of usage by coloring a predetermined recording region in accordance with the amount of usage may be recorded on the recording target section 63. By employing such a configuration, it is possible to leave a record of an accumulated amount of usage by recording amounts of usage every time the maintenance is executed even if the maintenance unit 22 is not provided with the storage medium 28.

As illustrated in FIG. 5, information 64 related to a validity date of the maintenance unit 22, information related to a product name thereof, and the like may be recorded in advance on the recording target section 63 in a stage of shipment. In the case in which the information 64 related to the validity date is recorded on the recording target section 63, the number of days until the validity date can be easily recognized by recording information 65 related to a detachment date in the vicinity of the information 64, for example. In a case in which the information related to the product name is too large to be recorded on the recording target section 63, the information related to the product name, the type and the like may be recorded in advance as a machine-readable code 66 (a barcode or a QR code (registered trademark), for example) on the recording target section 63.

Next, a description will be given of operations of the maintenance unit 22 and the liquid ejecting apparatus 11 configured as described above.

In a case in which the maintenance unit 22 is configured so as to be able to be detached as in the embodiment, there is a possibility that the maintenance unit 22 in the course of usage is detached from the liquid ejecting apparatus 11 and is then attached to the same liquid ejecting apparatus 11 or another liquid ejecting apparatus 11 after elapse of a predetermined period of time.

If the maintenance unit 22 is detached from the liquid ejecting apparatus 11 as described above and information related to the date on which the maintenance unit 22 is attached to the liquid ejecting apparatus 11, the detachment date, the usage history, and the like is recorded on the recording target section 63 in the visually recognizable manner, it becomes possible to easily reuse the maintenance unit 22. In a case of owning a plurality of maintenance units 22, for example, it is possible to use the maintenance units 22 in an order from the maintenance unit, the validity date of which is the closest, by checking the validity dates thereof.

In addition, it is possible to use the maintenance units 22 in such a manner that a maintenance member 21, the remaining amount of which is small, is replaced with another maintenance unit 22, the remaining amount of which is large, for performing printing processing that continues for a long period of time, and the maintenance unit 22, the remaining amount of which is small, is attached again and completed when another printing operation for a small amount of copies is performed.

In contrast, if no information is recorded on the recording target section 63, it is necessary to attach the maintenance unit 22 to the liquid ejecting apparatus 11 and to read information from the storage medium 28 by the control section 20. Therefore, such a situation that it is found that the validity date has already been expired after the user takes the trouble to mount the maintenance unit 22 to the liquid ejecting apparatus 11 occurs. In such a case, it is not possible to perform printing until a new maintenance unit 22 is prepared. Furthermore, if the maintenance unit 22 is not provided with the storage medium 28, there is a concern that printing quality is degraded or waste liquid leaking from the liquid receiving section 61 or the like contaminates the inside of the apparatus since the maintenance is executed in a state after expiration of the validity date and a sufficient maintenance effect cannot be obtained.

On that regard, if the information related to the validity date is recorded on the recording target section 63, it is possible to recognize the validity date or the like without taking trouble to attach the maintenance unit 22 to the liquid ejecting apparatus 11 in order to check the information and to thereby appropriately use the maintenance unit 22 with reference to the information. Furthermore, if detailed product information of the maintenance unit 22 is recorded as a QR code (registered trademark) or the like on the recording target section 63, it is possible to purchase another maintenance unit 22 for replacement in advance before the validity date or while an available part of the maintenance unit 22 still remains by reading the code with a machine such as a mobile terminal. Therefore, it is possible to appropriately manage stock of the maintenance unit 22 for replacement.

If some problem occurs in the liquid ejecting section 15, it is possible to presume a factor of the ejection failure with reference to the information (3), (6), and (7) recorded on the recording target section 63.

According to the embodiment, the following effects can be achieved.

(1) By causing the liquid ejecting section 15 to perform recording on the recording target section 63 when the maintenance unit 22 is attached to the liquid ejecting apparatus 11, information related to the maintenance section is brought into a state in which the information can be visibly recognized from the outside. That is, it is possible to obtain the information related to the maintenance section even in a state in which the maintenance unit 22 is detached from the liquid ejecting apparatus 11 and to thereby obtain necessary information without attaching the maintenance unit 22 to the liquid ejecting apparatus 11.

(2) In a case in which the validity date is set for the maintenance member 21, the liquid receiving section 61, and the like that configure the maintenance section, it is possible to easily recognize the number of days remaining until the validity date based on recorded information by recording information related to a date, on which the maintenance unit 22 is attached to the liquid ejecting apparatus 11, on the recording target section 63.

(3) In a case in which there is a concern that the maintenance section after start of usage is degraded over time, it is possible to expect a degree of the degradation based on recorded information by recording information related to a date, on which the maintenance unit 22 is detached from the liquid ejecting apparatus 11, on the recording target section 63.

(4) In a case in which the number of times the maintenance section can be used is limited, it is possible to easily recognize how long the maintenance unit 22 can be used from then based on recorded information by recording information related to a usage history of the maintenance section on the recording target section 63.

(5) There is a case in which types of liquid to be used for ejection and maintenance differ depending on a type of the liquid ejecting apparatus 11 and it is not preferable that such liquid adheres to the liquid ejecting section 15 in a different type of liquid ejecting apparatus 11. If the maintenance unit 22 in the course of usage is shared by such different types of liquid ejecting apparatuses 11 in this case, there is a concern that inappropriate liquid is made to adhere to the different liquid ejecting section 15 via the wiping section 31. On that regard, according to the embodiment, it is possible to avoid re-attachment of the maintenance unit 22 to an inappropriate liquid ejecting apparatus 11 with reference to recorded information by recording information related to the liquid ejecting apparatus 11, to which the maintenance unit 22 is attached, on the recording target section 63.

(6) It is possible to easily recognize how long the maintenance unit 22 can be used from then with reference to a validity date that is recorded in advance on the recording target section 63 without attaching the maintenance unit 22 to the liquid ejecting apparatus 11.

(7) It is possible to appropriately attach the maintenance unit 22 to the liquid ejecting apparatus 11 that is compatible with the product with reference to a product name that is recorded in advance on the recording target section 63. In addition, it is possible to avoid an erroneous order of a different type of maintenance unit 22 when the user orders the maintenance unit 22 for replacement that will be used next, with reference to the product name.

(8) In a case in which the region of the recording target section 63 is not large enough to sufficiently record the information related to the product name, it is possible to obtain detailed information of the product by recording the information related to the product name as a machine-readable code 66 in the recording target section 63 and allowing the user to read the code 66 with a machine. In doing so, it is possible to correctly order a new maintenance unit 22 for replacement based on information obtained from the code 66.

In addition, the above embodiments may be changed as in modification examples that will be described below.

Instead of impregnating the maintenance member 21 that is used for the maintenance of the liquid ejecting section 15 with the liquid for the maintenance in advance, the liquid may be supplied from a supply section of the liquid for maintenance, which is separately provided in the maintenance unit 22, to the maintenance member 21, and the maintenance member 21 may be impregnated with the liquid before performing the wiping by using the maintenance member 21.

Figure 6:
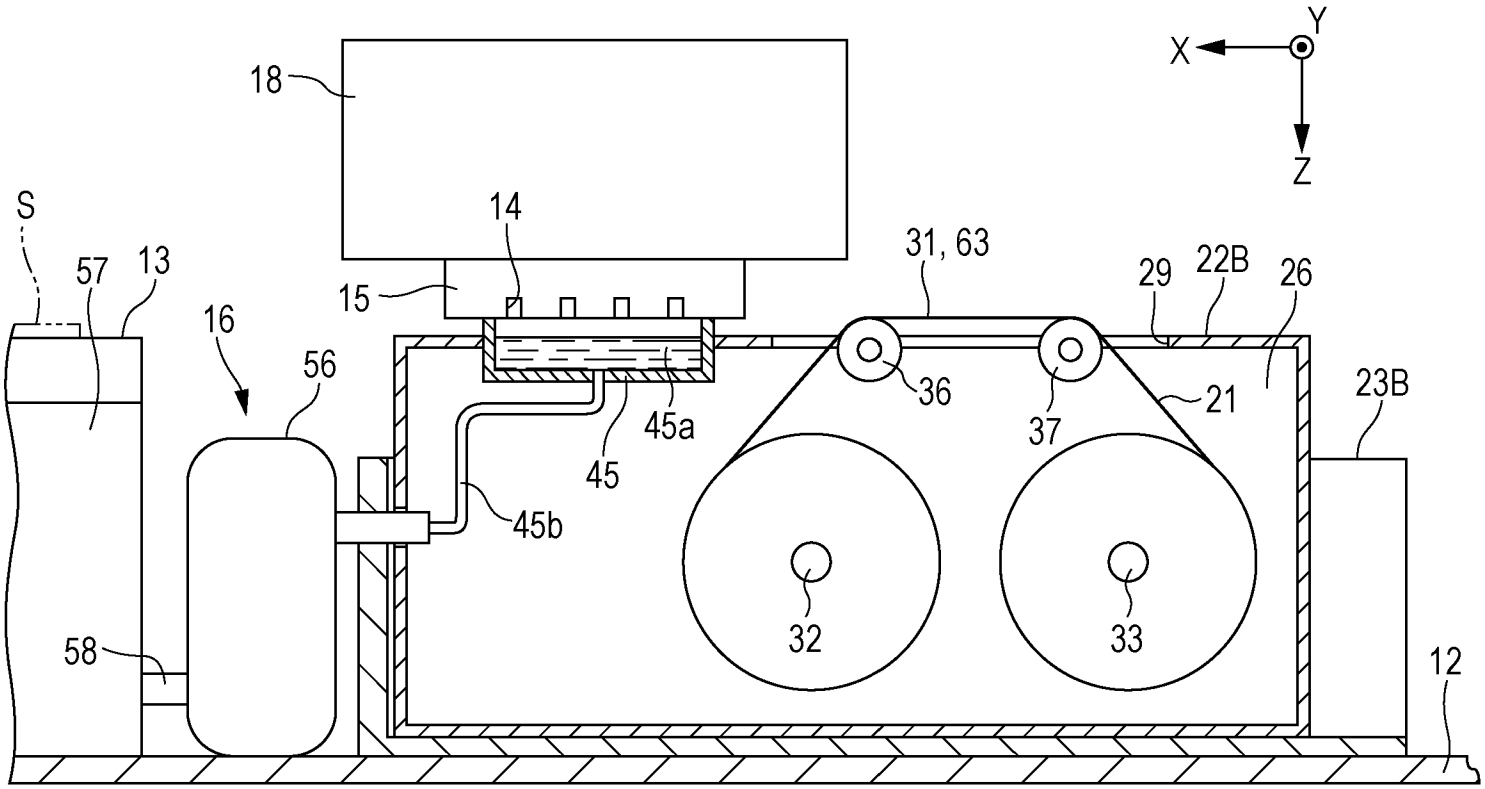
FIG. 6 is a cross-sectional view illustrating a first modification example of the maintenance unit and the attachment section.

As in the first modification example illustrated in FIG. 6, a maintenance unit 22B that is capable of performing capping and suctioning cleaning as a maintenance operation of the liquid ejecting section 15 instead of wiping and flushing may be attached to an attachment section 23B. The maintenance unit 22B includes a cap 45 as a maintenance section at a position at which the cap 45 is aligned with the wiping section 31 in the moving direction X, and performs capping of changing the space to which the nozzles 14 of the liquid ejecting section 15 opens into a closed space by bringing the cap 45 into contact with the liquid ejecting section 15 so as to surround the nozzles 14. In doing so, it is possible to suppress drying of the nozzles 14. In addition, an absorbing body 45*a* that is capable of absorbing liquid may be accommodated in the cap 45.

Furthermore, a suctioning tube 45*b* that communicates with the inside of the cap 45 may be accommodated in the accommodation section 26, and the maintenance device 16 may be provided with a suctioning pump 56, a waste liquid tank 57, and a discharge tube 58 that extends from the suctioning pump 56 to the waste liquid tank 57. With such a configuration, it is possible to execute suctioning cleaning for discharging foreign matters such as air bubbles along with liquid in the liquid ejecting section 15 by driving the suctioning pump 56 in a capped state. In a case of employing this configuration, it is preferable to attach the maintenance unit 22B to the attachment section 23B in the following manner. That is, the maintenance unit 22B is moved in the ejecting direction Z and is then accommodated in the attachment section 23B from a state in which the maintenance unit 22B is arranged above the attachment section 23B, and the maintenance unit 22B is then made to slide in the moving direction X. With the movement, the suctioning tube 45*b* is connected to the suctioning pump 56.

If the suctioning cleaning is executed on the liquid ejecting apparatus 11, there is a case in which the liquid discharged from the nozzles 14 by the suctioning adheres to the opening surface 15*a*. In such a case, the maintenance device 16 performs the aforementioned wiping by using the maintenance member 21.

Since it is possible to perform flushing in the cap 45 if the maintenance unit 22B is provided with the cap 45, it is not necessary for the maintenance unit 22B to be provided with the liquid receiving section 61.

As the first modification example illustrated in FIG. 6, two stretch rollers 36 and 37 may be provided so as to have circumferential surfaces that partially project from the opening section 29, and the length of the wiping section 31 in the moving direction X may be enlarged by arranging the stretch rollers 36 and 37 at separate positions in the moving direction X. In a case of employing the configuration, it is preferable to provide a mechanism for moving the position of the wiping section 31 in the ejecting direction Z (lower direction) or a mechanism for moving the position of the liquid ejecting section 15 in the opposite direction of the ejecting direction Z (upper direction). In doing so, it is possible to use the wiping section 31 as the recording target section by using the mechanism to change the distance between the liquid ejecting section 15 and the wiping section 31 in the ejecting direction Z and ejecting liquid from the liquid ejecting section 15 to the wiping section 31. That is, it is possible to record (print) the aforementioned information on an unused portion of the maintenance member 21 by arranging the unused portion between the two stretch rollers 36 and 37 after execution of the wiping. In such a case, flushing may be performed from the liquid ejecting section 15 to the wiping section 31.

The maintenance unit 22 may include, as a maintenance section, a waste liquid accommodation section (waste liquid tank) for accommodating waste liquid that is discharged from the liquid ejecting section 15 during cleaning or flushing as a maintenance operation. In the first modification example as illustrated in FIG. 6, for example, it is possible to replace the waste liquid tank 57 when the maintenance unit 22 is replaced, by arranging the waste liquid tank 57 in the accommodation section 26. In such a case, an accumulated number of times the suctioning cleaning is executed, a remaining volume with respect to the volume of liquid that can be accommodated in the waste liquid tank, or the like corresponds to the usage history of the maintenance section (waste liquid tank).

Figure 7:
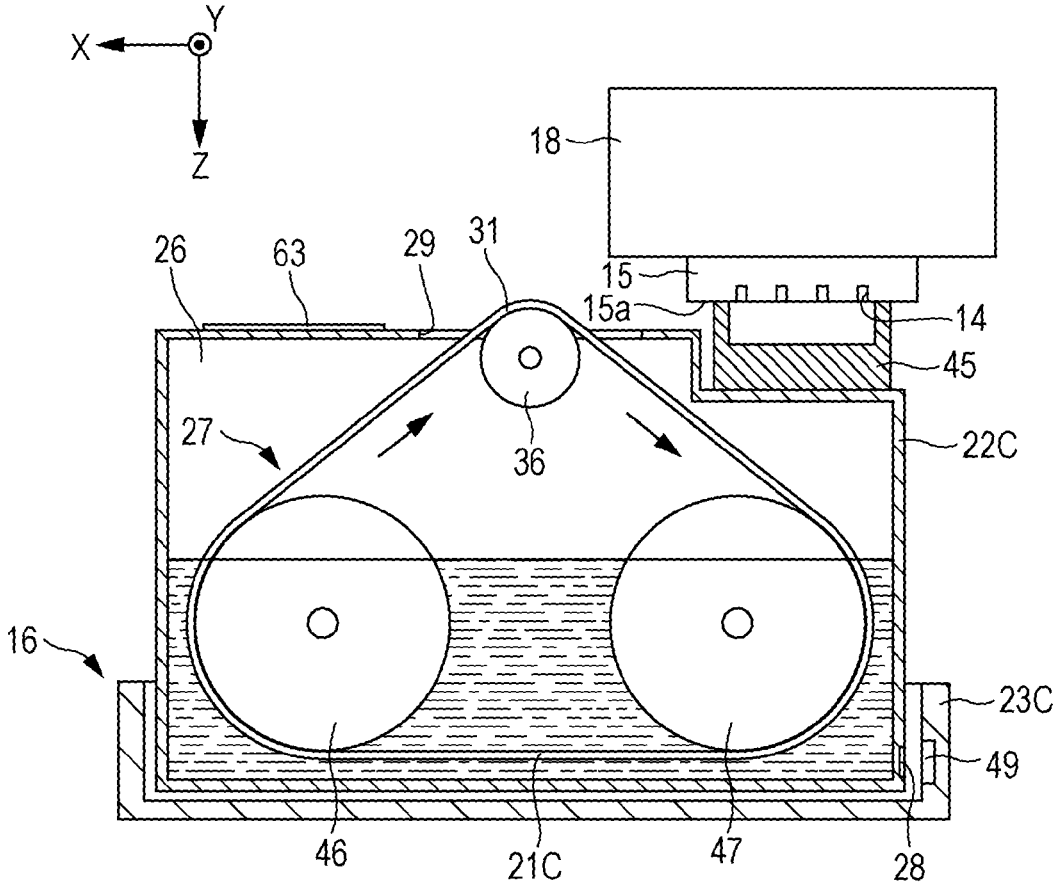
FIG. 7 is a cross-sectional view illustrating a second modification example of the maintenance unit and the attachment section.

As in the second modification example illustrated in FIG. 7, a maintenance unit 22C that is capable of executing capping as a maintenance operation of the liquid ejecting section 15 instead of the wiping may be attached to an attachment section 23C. That is, the maintenance unit 22C includes the cap 45 at a position at which the cap 45 is aligned with the wiping section 31 in the moving direction X and performs capping of changing the space to which the nozzles 14 of the liquid ejecting section 15 opens into a closed space by bringing the cap 45 into contact with the liquid ejecting section 15 so as to surround the nozzles 14. In doing so, it is possible to suppress drying of the nozzles 14.

As in the second modification example illustrated in FIG. 7, the maintenance member 21C has an endless shape. In such a case, it is possible to move the maintenance member 21C along with rotation of belt rollers 46 and 47 by stretching the endless maintenance member 21C over the belt rollers 46 and 47.

In addition, liquid may be accommodated in the accommodation section 26 of the maintenance unit 22C such that a part of the maintenance member 21C is dipped thereinto. Since pigment, foreign matters, and the like contained in the received liquid are washed with the liquid every time the maintenance member 21C is brought into contact with the liquid in this case, it is possible to repeatedly reuse the maintenance member 21C. In a case of employing the configuration, it is preferable to set the validity date, the number of time until the life duration ends, and the like for the maintenance unit 22C based on how easily the liquid stored in the accommodation section 26 is evaporated and how easily properties thereof vary, for example.

As in the second modification example illustrated in FIG. 7, the attachment section 23 may be provided with a communication unit 49 for exchanging data in a non-contact manner, and data may be read and written without requiring contact with the storage medium 28 that is included in the maintenance unit 22.

In the above embodiment, the liquid receiving section 61, the wiping section 31 (maintenance section), and the recording target section 63 are aligned on the top surface 26*t* of the accommodation section 26 in this order in the longitudinal direction from the side that is close to the ejection region. However, the alignment order can be arbitrarily changed. For example, the recording target section 63 may be arranged at a position that is close to the ejecting region beyond the wiping section 31 (maintenance section) on the top surface 26*t* of the accommodation section 26 as in the second modification example illustrated in FIG. 7.

If the recording target section 63 is arranged at the position that is close to the ejection region, a distance by which the liquid ejecting section 15 moves from the ejection region before printing is performed on the recording target section 63. Therefore, there is an advantage that it is possible to quickly perform the printing. In contrast, if the recording target section 63 is arranged at a position that is far from the ejection region, adhesion of mist to the recording target section 63 that is caused when liquid is ejected (printed) is suppressed in the ejection region. Therefore, there is an advantage that the recording target section 63 is not easily contaminated by the mist.

Since the liquid ejecting section 15 is typically brought into a stand-by state of being capped with the cap 45 when liquid ejection is not performed, the cap 45 is often located at a home position corresponding to the stand-by position of the liquid ejecting section 15. Therefore, of the recording target section 63 is arranged at the position that is close to the ejection region beyond the cap 45 on the top surface 26*t* of the accommodation section 26, it is possible to perform printing on the recording target section 63 while the liquid ejecting section 15 moves between the ejection region and the home position and to shorten the moving direction of the liquid ejecting section 15, which is preferable. In this case, the cap 45 may be provided in the maintenance device 16 as a separate component from the maintenance unit 22.

As in the modification examples illustrated in FIGS. 6 and 7, a configuration is also applicable in which the attachment sections 23B and 23C do not move. In such a case, it is possible to perform the wiping of the liquid ejecting section 15 by moving the liquid ejecting section 15 along the moving direction X relative to the wiping section 31. Alternatively, the wiping may be performed on the liquid ejecting section 15 that is stopping in the maintenance region by enlarging the opening section 29 in the moving direction X and moving the stretch roller 36, which is arranged so as to project from the opening section 29, in the moving direction X.

As in the modification examples illustrated in FIGS. 6 and 7, the attachment sections 23B and 23C may not have such a size (height) that the maintenance units 22B and 22C can be accommodated as a whole.

The maintenance member 21 for wiping is not limited to the long absorption member, and an elastically deformable plate-shaped wiping member (wiper) that is made of elastomer or the like may be used as the maintenance member, and the liquid ejecting section 15 may be wiped with the tip end of the wiper corresponding to the wiping section. In a case of employing the configuration, there is a high possibility that different types of liquid adheres to the liquid ejecting section 15 if the wiper is used for wiping different liquid ejecting sections 15 that ejects different types of liquid since the wiping section is not replaced with an unused portion unlike the maintenance member 21. Therefore, it is preferable to record the information (3) or (6) on the recording target section 63.

Both the long absorption member and the elastically deformable plate-shaped wiping member (wiper) that is made of elastomer or the like may be provided As the maintenance member 21 for wiping, and the liquid ejecting section 15 may be wiped with these two types of members.

As in the modification examples illustrated in FIGS. 6 and 7, liquid may be supplied from the liquid accommodation body that is arranged inside or outside the case body 12 to the liquid ejecting section 15 via a liquid tube that is not illustrated in the drawing without attaching the liquid accommodation body 19 to the carriage 18. That is, the liquid accommodation body 19 that accommodates the liquid to be supplied to the liquid ejecting section 15 is not limited to a so-called on-carriage type that is detachable mounted to the carriage 18, and may be a so-called off-carriage type that is fixed to a predetermined location other than the carriage 18 in the case body 12.

The wiping section 31 may be wipe the liquid ejecting section 15 by moving the attachment section 23 in the transport direction Y. In such a case, it is preferable that the recording target section 63, the wiping section 31, and the liquid receiving section 61 are aligned in the transport direction Y on the top surface 26*t* of the accommodation section 26.

The configuration of the maintenance section that is provided in the maintenance unit 22 is not limited to the aforementioned configuration and can be arbitrarily changed as long as the maintenance section requires to be exchanged after usage for a predetermined period of time or after elapse of a predetermined period of time from fabrication.

In formation can be provided to the user by displaying information on the display section 55, outputting a buzzer sound, a sound guide, or the like, or turning on and off or blinking a display light.

The number of times remaining until the life duration of the maintenance unit 22 ends, the remaining length of the unused portion of the maintenance member 21, the number of days remaining before the validity date, or the like may be displayed on the display section 55. With such a configuration, the user can prepare the maintenance unit 22 for replacement that will be used next at an appropriate timing with reference to the remaining number of times or the like.

The maintenance unit 22 may not be provided with the storage medium 28 for storing information related to the maintenance section. In such a case, the information that is stored on the storage medium 28 may be stored on a storage section that is provided in the liquid ejecting apparatus 11 instead.

The liquid that is ejected by the liquid ejecting section 15 is not limited to ink and may be a liquid-form substance obtained by dispersing or mixing functional material particles, for example, in a liquid. For example, a configuration is also applicable in which a liquid-form substance that contains materials such as an electrode material or a color material (pixel material) which are used for manufacturing a liquid crystal display, an electroluminescence (EL) display, a surface emitting display, or the like in a dispersed or dissolved manner is ejected for recording.

The liquid ejecting apparatus may be changed to a so-called full line-type liquid ejecting apparatus that is provided with a long fixed liquid ejecting section 15 that corresponds to the whole width of the medium S instead of the carriage 18. The liquid ejecting section 15 in this case may be configured such that a printing range covers the whole width of the medium S by arranging a plurality of unit head sections with the nozzles 14 formed therein in a parallel manner or such that the printing range covers the whole width of the medium S by arranging multiple nozzles 14 in a single long head so as to cover the whole width of the medium S.

The liquid accommodation body 19 may be configured such that a flexible bag accommodating liquid is accommodated in a rigid case or may be configured such that the liquid is accommodated directly in the rigid case.

The liquid accommodation body 19 may be provided with an inlet port to which liquid can be injected such that the liquid can be injected or replenished through the inlet port. With such a configuration, it is possible to replenish the liquid without detaching and attaching the liquid accommodation body 19.

The medium is not limited to a sheet and may be a plastic film, a thin plate material, or fabric that is used for cloth-printing apparatus or the like.

The entire disclosure of Japanese Patent Application No. 2014-236783, filed Nov. 21, 2014 is expressly incorporated by reference herein.

What is claimed is:

1. A maintenance unit that is detachably attached to a liquid ejecting apparatus including a liquid ejecting section for ejecting liquid, the maintenance unit comprising:

a maintenance section that is used for maintenance of the liquid ejecting section; and a recording target section located on a surface of the maintenance unit facing the liquid ejecting section in which information related to the maintenance section is recorded by the liquid that is ejected by the liquid ejecting section onto the recording target section in a visibly recognizable manner.

2. The maintenance unit according to claim 1, wherein the information includes information related to a date on which the maintenance unit is attached to the liquid ejecting apparatus.

3. The maintenance unit according to claim 1, wherein the information includes information related to a date on which the maintenance unit is detached from the liquid ejecting apparatus.

4. The maintenance unit according to claim 1, wherein the information includes information related to a usage history of the maintenance section.

5. The maintenance unit according to claim 1, wherein the information includes information related to the liquid ejecting apparatus to which the maintenance unit is attached.

6. The maintenance unit according to claim 1, wherein a validity date of the maintenance unit is recorded in advance on the recording target section.

7. The maintenance unit according to claim 1, wherein information related to a product name of the maintenance unit is recorded in advance on the recording target section.

8. The maintenance unit according to claim 7, wherein the information related to the product name is recorded as a machine-readable code in advance on the recording target section.

9. The maintenance unit according to claim 1, further comprising:

an accommodation section that accommodates the maintenance section, wherein the recording target section is provided on a surface, which corresponds to the liquid ejecting section, of the accommodation section.

10. The maintenance unit according to claim 1, wherein a long maintenance member is included as the maintenance section, and wherein the recording target section corresponds to an unused portion of the maintenance member.

11. A liquid ejecting apparatus comprising:

a liquid ejecting section that ejects liquid; and an attachment section to which a maintenance unit including a recording target section and a maintenance section that is used for maintenance of the liquid ejecting section is detachably attached, wherein the liquid ejecting section records information related to the maintenance section in a visibly recognizable manner by ejecting the liquid onto the recording target section of the maintenance unit that is attached to the attachment section, the recording target section being located on a surface of the maintenance unit facing the liquid ejecting section.

* * * * *